US012305462B2

(12) United States Patent
Atkins

(10) Patent No.: US 12,305,462 B2
(45) Date of Patent: May 20, 2025

(54) MILLING TOOL

(71) Applicant: Paul Atkins, Phuket (TH)

(72) Inventor: Paul Atkins, Phuket (TH)

( * ) Notice: Subject to any disclaimer, the term of this patent is extended or adjusted under 35 U.S.C. 154(b) by 0 days.

(21) Appl. No.: 18/274,189

(22) PCT Filed: Feb. 8, 2022

(86) PCT No.: PCT/AU2022/050065
§ 371 (c)(1),
(2) Date: Jul. 25, 2023

(87) PCT Pub. No.: WO2022/174282
PCT Pub. Date: Aug. 25, 2022

(65) Prior Publication Data

US 2024/0093561 A1 Mar. 21, 2024

(30) Foreign Application Priority Data

Feb. 17, 2021 (AU) ..... 2021900394

(51) Int. Cl.
*E21B 29/00* (2006.01)
*E21B 23/04* (2006.01)
*E21B 29/06* (2006.01)

(52) U.S. Cl.
CPC ..... *E21B 29/06* (2013.01); *E21B 23/04* (2013.01)

(58) Field of Classification Search
CPC ..... E21B 29/005; E21B 29/002
See application file for complete search history.

(56) References Cited

U.S. PATENT DOCUMENTS

| | | | | |
|---|---|---|---|---|
| 2,735,485 | A * | 2/1956 | Metcalf | E21B 29/002 30/103 |
| 2008/0041597 | A1* | 2/2008 | Fisher | E21B 47/00 166/381 |
| 2015/0267493 | A1 | 9/2015 | Schwartze et al. | |
| 2015/0354306 | A1* | 12/2015 | Fuller | E21B 17/1078 166/55.7 |
| 2015/0376966 | A1 | 12/2015 | Balasubramanian et al. | |
| 2017/0321509 | A1* | 11/2017 | Hart | E21B 29/005 |
| 2022/0042389 | A1* | 2/2022 | Al-Mousa | E21B 10/32 |

* cited by examiner

*Primary Examiner* — Tara Schimpf
*Assistant Examiner* — Ursula Lee Norris
(74) *Attorney, Agent, or Firm* — Michelle L. Gross, P.C.

(57) ABSTRACT

A milling tool for cutting an inner casing string of a wellbore, the milling tool comprising a tool body, an extendable cut-out blade located in the tool body and configured to cut the inner casing string to form a starter window, and an extendable milling blade located in the tool body and configured to cut the inner casing string to form a full-length window, wherein the milling blade is configured to extend from the tool body independently from the cut-out blade, and wherein the cut-out blade and the milling blade are configured to extend from the tool body by circulating drilling fluid through the milling tool.

20 Claims, 8 Drawing Sheets

12
218
213
270
230
140
212
250
253
130
210
242
221
243
200
240
223
222
220
260
121
120
111
211
100
215
110
10
11
15

272

MILLING TOOL

FIELD OF THE INVENTION

The invention relates to a milling tool. In particular, the invention relates, but is not limited, to a milling tool in the form of a dual blade section mill for cutting/milling a window in an inner casing string of a wellbore.

BACKGROUND TO THE INVENTION

Reference to background art herein is not to be construed as an admission that such art constitutes common general knowledge in Australia or elsewhere.

Oil and gas wells are ordinarily completed by first cementing metallic casing strings in the borehole. Depending on the properties of the formation (e.g., formation porosity), dual casing strings may be employed, for example, including a smaller diameter casing string (inner string) deployed internal to a larger diameter casing string (outer casing string). In such dual or multiple casing string wellbores, the internal string is commonly cemented to the larger diameter string (i.e., the annular region between the first and second strings is filled or partially filled with cement).

When oil and gas wells are no longer commercially viable, they must be abandoned in accordance with local government regulations. In certain jurisdictions, well abandonment requires a length of the wellbore casing to be removed prior to filling the wellbore with a cement plug. The inner casing string is commonly removed via a milling operation that requires inserting a milling tool in the wellbore with blades suitable for forming a starter window (a circumferential cut in the string), forming the starter window with the milling tool, pulling the milling tool out from the wellbore to change the blades to those suitable to form the full-length window and then re-inserting the tool in the wellbore to form the full-length window. These multiple operations are both time consuming and expensive and therefore are undesirable. Further, the blades used for forming the full-length window tend to damage the outer casing string as they may extend beyond a desired position.

OBJECT OF THE INVENTION

It is an aim of this invention to provide a milling tool which overcomes or ameliorates one or more of the disadvantages or problems described above, or which at least provides a useful alternative.

Other preferred objects of the present invention will become apparent from the following description.

SUMMARY OF INVENTION

In one form, although not necessarily the only or broadest form, the invention resides in a milling tool for cutting an inner casing string of a wellbore, the milling tool comprising:

a tool body;

an extendable cut-out blade located in the tool body and configured to cut the inner casing string to form a starter window; and an extendable milling blade located in the tool body and configured to cut the inner casing string to form a full-length window, wherein the milling blade is configured to extend from the tool body independently from the cut-out blade, and wherein the cut-out blade and the milling blade are configured to extend from the tool body by circulating drilling fluid through the milling tool.

Preferably, the milling tool is a dual blade section mill. Preferably, the milling tool has a first end and a second end. Preferably, the first and second ends can be coupled with a drill string.

Preferably, the tool body has an inner assembly and an outer assembly. Preferably, the inner assembly has a first mandrel, a connection sleeve connected to the first mandrel, a second mandrel connected to the connection sleeve and a third mandrel connected to the second mandrel. Preferably, the first mandrel, connection sleeve, second mandrel and third mandrel are cylindrical in shape.

Preferably, the first mandrel, connection sleeve, second mandrel and third mandrel have central bores that align with each other. Preferably, the first mandrel, connection sleeve, second mandrel and third mandrel are fluidically connected to each other. Preferably, the central bores of the first mandrel, connection sleeve, second mandrel and third mandrel provide a fluid pathway for the drilling fluid.

Preferably, an end of the first mandrel comprises a J-slot portion that engages with the outer housing. Preferably, engagement of the J-slot portion with the outer housing allows for rotational torque to be transmitted to the outer assembly from the inner assembly.

Preferably, the connection sleeve has a plurality of apertures. Preferably, each of the plurality of the apertures extends from the central bore of the connection sleeve to an outer surface of the connection sleeve. Preferably, the plurality of apertures allow the drilling fluid to flow out from the central bore of the connection sleeve via the plurality of apertures.

Preferably, the outer assembly is slidable relative to the inner assembly. Preferably, the outer assembly includes an outer housing. Preferably, the outer housing includes a first portion, a middle portion and a second portion.

Preferably, an end of the first portion is connected to a debris cap. Preferably, the first portion of the outer housing includes a cut-out for the cut-out blade to extend through. Preferably, the first portion of the outer housing includes at least three cut-outs. Preferably, each cut-out is located adjacent one of the cut-out blades. Preferably, each cut-out is sized such that a portion of the cut-out blade can extend outwardly through the cut-out.

Preferably, the first portion of the outer housing encases the J-slot portion of the first mandrel. Preferably, the first portion includes an internal lug extending radially inwards from the inner wall of the first portion. Preferably, the internal lug engages with the recess of the J-slot portion. Preferably, the engagement of the internal lug with the recess of the J-slot portion of the first mandrel allows for rotational torque to be transmitted to the outer assembly from the inner assembly.

Preferably, the outer assembly further includes a piston assembly for extending the cut-out blades. Preferably, the piston assembly extends through the first portion of the outer housing.

Preferably, the piston assembly includes a wedge rod, a piston head connected to the wedge rod and a compression spring located between the wedge rod and the piston head. Preferably, the wedge rod is in the shape of a hollow cylinder and has a hollow central tubular portion. Preferably, the second mandrel extends through the hollow portion of the wedge rod.

Preferably, the wedge rod includes a projection that extends radially outwards from the wall of the wedge rod.

Preferably, the projection is located at a distal end of the wedge rod. Preferably, the projection has a trapezoidal cross-sectional shape. Preferably, the projection aligns with the distal portion of the cut-out blade. Preferably, movement of the wedge rod relative to the outer housing results in the cut-out blade pivoting radially outwards from the first portion through the cut-outs of the first portion. Preferably, the second mandrel extends through the wedge rod.

Preferably, the first portion of the outer housing includes a first annular projection extending inwardly from an internal wall of the first portion. Preferably, the first annular projection is located adjacent the connection sleeve. Preferably, the first annular projection sealingly engages with the outer surface of the connection sleeve. Preferably, a seal is located between the first annular projection and the outer surface of the connection sleeve. Preferably, a space enclosed by the first annular projection and the first end of the piston head forms a pressure chamber. Preferably, the plurality of apertures of the connection sleeve allow the drilling fluid to flow into the pressure chamber from the connection sleeve.

Preferably, the first portion of the outer housing includes a second annular projection and a third annular projection extending inwardly from an internal wall of the first portion. Preferably, the first, second and third annular projections are spaced from each other along a longitudinal axis of the milling tool. Preferably, the second annular projection is located between the piston head and the third annular projection. Preferably, the second annular projection extends around the spring but is spaced from the spring in a direction transverse to the longitudinal axis. Preferably, the second annular projection prevents the piston head from moving beyond the second annular projection towards the second end of the milling tool.

Preferably, the third annular projection is located between the spring and the cut-out blade. Preferably, the third annular projection supports an end of the spring. Preferably, a central aperture of the third annular projection is sized to allow the wedge rod to extend therethrough.

Preferably, the first portion of the outer housing further includes at least two apertures configured to allow drilling fluid in the pressure chamber of the first portion to flow out of the pressure chamber. Preferably, the at least two apertures are nozzles. Preferably, the at least two apertures are spaced from each other and located on opposite sides of the pressure chamber. Preferably, the at least two apertures are configured to direct the flow of drilling fluid towards the first end of the milling tool.

Preferably, the milling tool includes at least three cut-out blades. Preferably, a distal portion of the cut-out blade includes a plurality of cutting elements. Preferably, the distal portion of the cut-out blade further includes a stop member and a spring connected to the stop member.

Preferably, the stop member extends outwardly and beyond the plurality of cutting elements. Preferably, the stop member is sized such that it obstructs movement of the cut-out blade beyond a predetermined position.

Preferably, the spring of the distal portion of the cut-out blade is a leaf spring. Preferably, the spring is partially arcuate in shape. Preferably, the spring is removably connected to the stop member. Preferably, tension in the spring enables the cut-out blade to retract into the outer housing.

Preferably, the cut-out blade is connected to the first portion of the outer housing by a retaining pin. Preferably, the retaining pin is located through apertures formed in the wall of the first portion. Preferably, the cut-out blade pivots about the retaining pin. Preferably, the apertures formed in the wall of the first portion extend from the internal surface of the first portion to the outer surface of the first portion. Preferably, the retaining pin is accessible from an exterior of the outer housing.

Preferably, an outer surface of the middle portion of the outer housing includes a plurality of linear projections that extend parallel to the longitudinal axis of the milling tool. Preferably, the plurality of linear projections are transversely spaced from each other and extend radially outwards from the outer surface of the middle portion. Preferably, the plurality of linear projections are stabilizing fins.

Preferably, the middle portion of the outer housing includes a cut-out for the milling blade to extend through. Preferably, the middle portion of the outer housing includes at least three cut-outs. Preferably, each cut-out is located adjacent one of the milling blades. Preferably, each cut-out is sized such that a portion of the milling blade can extend outwardly through the cut-out.

Preferably, the milling tool includes at least three milling blades. Preferably, a distal portion of the milling blade includes a plurality of cutting elements. Preferably, the milling blade further includes at least one stop member. Preferably, the stop member is a laterally extending projection. Preferably, the milling blade includes at least two stop members. Preferably, the stop members extend outwardly from opposite sides of the milling blade. Preferably, the stop members are located adjacent a proximal end of the milling blade. Preferably, the stop members are sized such that the stop members obstruct movement of the milling blade beyond a predetermined position.

Preferably, the milling blade is connected to the middle portion of the outer housing by a retaining pin. Preferably, the retaining pin is located through apertures formed in the wall of the middle portion. Preferably, the milling blade pivots about the retaining pin. Preferably, the apertures formed in the wall of the middle portion extend from the internal surface of the middle portion to the outer surface of the middle portion. Preferably, the retaining pin is accessible from an exterior of the outer housing.

Preferably, the third mandrel includes a projection. Preferably, the projection is located adjacent the distal end of the third mandrel. Preferably, the projection extends circumferentially along the wall of the third mandrel. Preferably, the projection has a trapezoidal cross-sectional shape. Preferably, the projection of the third mandrel aligns with the distal portion of the milling blade. Preferably, movement of the third mandrel relative to the middle portion of the outer housing results in the milling blade pivoting radially outwards from the middle portion.

Preferably, the second portion of the outer housing has a first section, a second section and an intermediate section located between the first and second sections. Preferably, the internal diameter of the first section is greater than the internal diameter of the second section. Preferably, the first section forms a pressure chamber into which the drilling fluid flows as it exits the distal end of the third mandrel.

Preferably, a plate is located at the junction of the first and intermediate sections of the second portion. Preferably, the plate is disc-shaped with a plurality of apertures formed through the plate.

Preferably, the middle portion of the outer housing includes at least three apertures configured to allow drilling fluid in the pressure chamber of the second portion to flow out of the pressure chamber. Preferably, the at least three apertures are nozzles. Preferably, the at least three apertures are spaced from each other and each of the at least three apertures is located between two adjacent linear projections of the plurality of linear projections. Preferably, the at least two apertures are configured to direct the flow of drilling fluid towards the first end of the milling tool.

Preferably, the milling tool further comprises a shear assembly.

Preferably, the shear assembly includes:

a shear sleeve;

an outer disconnect member operatively connected to the shear sleeve;

an inner disconnect member releasably engaged with the outer disconnect member; and a disconnect sleeve releasably engaged with the inner disconnect member.

Preferably, a locking member is located between the outer disconnect member and the disconnect sleeve. Preferably, the locking member engages with the outer disconnect member. Preferably, a projection of the locking member engages with a recess of the outer disconnect member. Preferably, the locking member engages with the inner disconnect member. Preferably, a base of the locking member engages with the inner disconnect member. Preferably, the base of the locking member has an arcuate cross-sectional shape.

Preferably, the shear assembly further includes a shear pin engaged with the inner disconnect member and the disconnect sleeve. Preferably, the shear pin prevents disengagement of the disconnect sleeve from the inner disconnect member.

Preferably, the disconnect sleeve is located inside the inner disconnect member. Preferably, the locking member prevents disengagement of the disconnect sleeve from the inner disconnect member.

Preferably, an O-ring is located between the disconnect sleeve and the inner disconnect member. Preferably, the O-ring prevents damage to the shear assembly. Preferably, the O-ring prevents the drilling fluid from flowing into an annular space between the disconnect sleeve and the inner disconnect member.

Preferably, the third mandrel extends through the shear sleeve. Preferably, the shear sleeve is connected to the outer housing.

Preferably, the milling tool can move between (i) a first closed position where the cut-out blade and the milling blade are not extended from the tool body, (ii) a first open position where the cut-out blade is extended and the milling blade is not extended from the tool body, and (iii) a second open position where the milling blade is extended and the cut-out blade is not extended from the tool body.

Preferably, disengagement of the shear member from the shear sleeve moves the milling tool to the second open position.

Preferably, the milling tool can move to a second closed position where the cut-out blades cannot be extended despite an increase in drilling fluid pressure.

Preferably, the milling tube is in the second closed position when an isolation tube is located in the connection sleeve. Preferably, the isolation tube is hollow and cylindrical in shape. Preferably, end portions of the isolation tube engage with seals located on an inner surface of the connection sleeve. Preferably, the isolation tube prevents drilling fluid from flowing into the pressure chamber from the connection sleeve.

In another form the invention resides in a method for cutting an inner casing string of a wellbore, the method comprising:

inserting a milling tool in the wellbore;

extending a cut-out blade located in a tool body of the milling tool;

cutting the inner casing string by the reaming block to form a starter window;

extending a milling blade located in the tool body; and cutting the inner casing string by the milling blade to form a full-length window, wherein the cut-out blade and the milling blade are extended from the tool body by circulating drilling fluid through the milling tool.

Preferably, extending the cut-out blade includes moving a piston head located in the tool body by the drilling fluid. Preferably, moving the piston head includes applying force on the piston head by the drilling fluid.

Preferably, extending the cut-out blade includes engaging a projection of a wedge rod with the cut-out blade.

Preferably, cutting the inner casing string to form the starter window includes rotating the milling tool when the cut-out blade is extended.

Preferably, extending the milling blade includes disengaging a shear member connected to the tool body from a shear sleeve. Preferably, disengaging the shear member from the shear sleeve includes dropping a shear ball on to the shear member and applying hydraulic pressure on the shear ball by the drilling fluid.

Preferably, extending the milling blade includes disengaging a disconnect sleeve from an inner disconnect housing. Preferably, extending the milling blade further includes disengaging the inner disconnect housing from an outer disconnect housing operatively connected to a shear sleeve. Preferably, the shear sleeve is connected to the tool body.

Preferably, disengaging the disconnect sleeve from the inner disconnect housing includes shearing a shear pin engaged with the disconnect sleeve and the inner disconnect housing. Preferably, shearing the shear pin includes dropping a shear ball on to the disconnect sleeve and applying hydraulic pressure on the shear ball by the drilling fluid.

Preferably, extending the milling blade further includes moving an inner assembly of the milling tool by the drilling fluid. Preferably, moving the inner assembly includes applying force on the shear sleeve by the drilling fluid.

Preferably, cutting the inner casing string to form the full-length window includes rotating the milling tool when the milling blade is extended into the window.

Preferably, extending the milling blade further includes dropping an isolation tube into a first mandrel from a first end of the milling tool. Preferably, the isolation tube engages with seals in the connection sleeve. Preferably, the isolation tube isolates the apertures of the connection sleeve such that drilling fluid cannot flow out of the apertures and into the pressure chamber.

Preferably, the milling tool is herein as described.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE DRAWINGS

Figures 1, 2, 3:
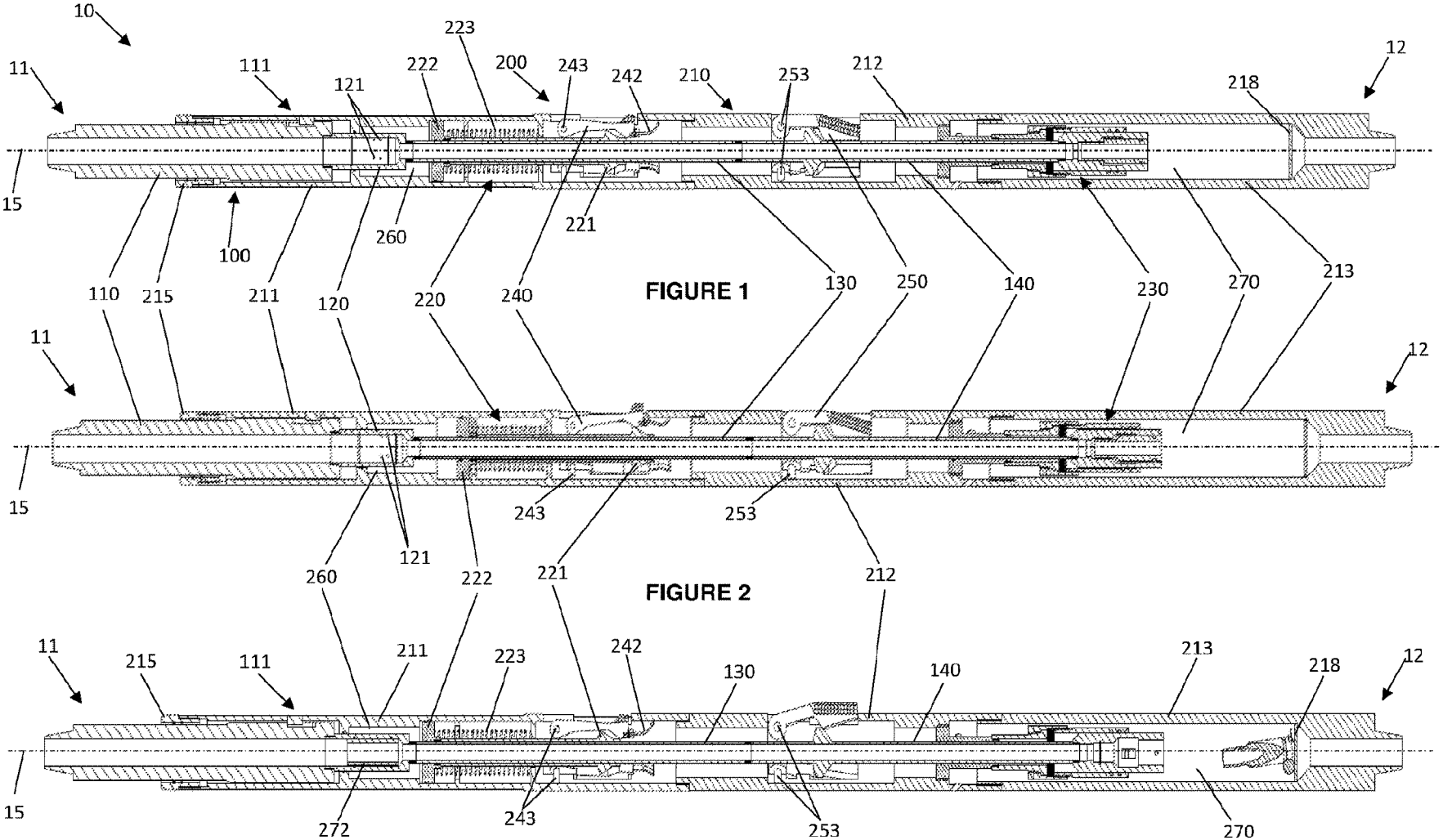
FIG. 1 illustrates a cross-sectional view of a milling tool, according to an embodiment of the invention.
FIG. 2 illustrates a cross-sectional view of the milling tool shown in FIG. 1 with the cut-out blades extended.
FIG. 3 illustrates a cross-sectional view of the milling tool shown in FIG. 1 with the milling blades extended.

FIGS. 1-3 illustrate a milling tool in the form of a dual blade section mill ('DBSM') 10 according to an embodiment of the invention. The DBSM 10 has a tool body including an inner assembly 100 and an outer assembly 200 that is connected and slidable relative to the inner assembly 100. The DBSM 10 has a first end 11 (which is a proximal end of the inner assembly 100) and a second end 12 (which is a distal end of the outer assembly 200) which can be coupled with a drill string (or other tool string).

Figure 4:
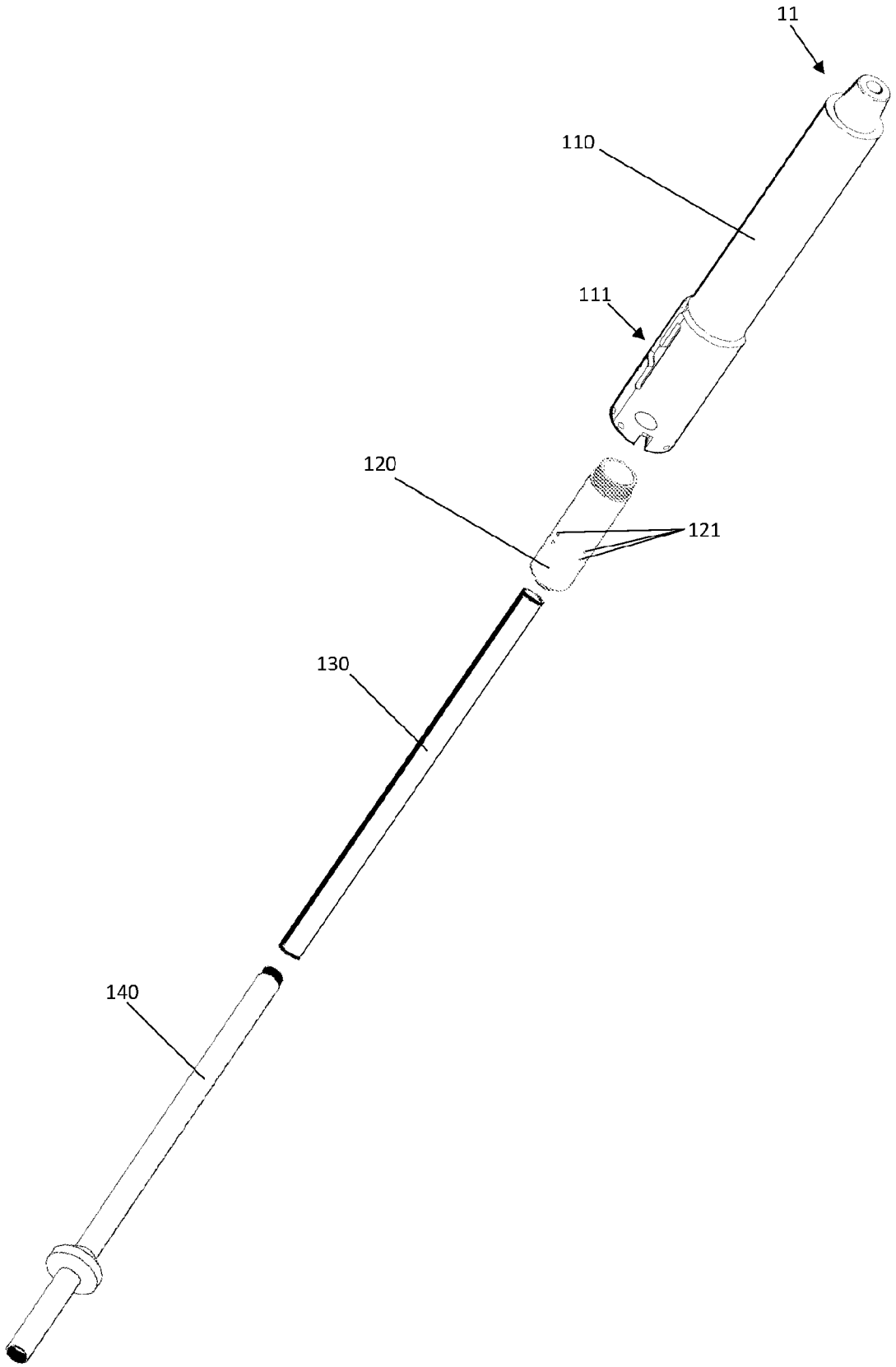
FIG. 4 illustrates an exploded view of the inner assembly of the milling tool shown in FIG. 1.

FIG. 4 illustrates an exploded view of the inner assembly. The inner assembly 100 comprises a cylindrical first mandrel 110 with a central bore that provides a fluid pathway for drilling fluid, a connection sleeve 120 fluidically connected to the first mandrel 110, a cylindrical second mandrel 130 connected to the connection sleeve 120*m*, and a cylindrical third mandrel 140 connected to the second mandrel 130. The connection sleeve 120 and the second and third inner mandrels 130, 140 also have a central bore that is aligned with the central bore of the first mandrel 110. The second mandrel 130 is fluidically connected to the first mandrel 110, with a first end of the second mandrel 130 connected to an end of the connection sleeve 120. A second end of the second mandrel 130 is connected to a first end of the third mandrel 140, thereby fluidically connecting the third mandrel 140 with the first mandrel 110. However, in further embodiments, the inner assembly 100 may comprise one, two or four or more mandrels. Moreover, in further embodiments, the second mandrel 130 may be directly connected to the first mandrel 110, thereby eliminating the need for a connection sleeve 120. The central bores of the first mandrel 110, connection sleeve 120, third mandrel 130 and fourth mandrel 140 form a fluid pathway for the drilling fluid.

The proximal end of the inner assembly 100 includes a portion of the first mandrel 110 that extends outwardly from the outer assembly 200, with the remaining portion of the first mandrel 110 extending into the outer assembly 200. A distal end of the first mandrel 110, i.e. the end that is connected to the connection sleeve 120, includes a J-slot portion 111 that has an outer diameter that is slightly greater than that of the remaining first mandrel 110. The J-slot portion 111 includes a recess in the form of a J-slot. However, in further embodiments, the J-slot portion 111 may include two or more recesses and/or the recess may be shaped differently.

The connection sleeve 120 is cylindrical in shape and has a plurality of apertures 121 with each aperture extending from the central bore of the connection sleeve 120 to an outer surface of the connection sleeve 120, thereby allowing drilling fluid to flow out from the central bore of the connection sleeve 120 to an exterior of the connection sleeve 120 via the plurality of apertures 121.

Drilling fluid is pumped into the first mandrel 110 from the first end 11 of the DBSM 10 (through the central bore of the first mandrel 110) and flows out through the distal end of the third mandrel 140, exiting the DBSM 10 at its second end 12.

The outer assembly 200 includes a cylindrical outer housing 210, a plurality of extendable cut-out blades 240, a piston assembly 220 for extending the cut-out blades 240, a plurality of extendable milling blades 250 and a shear assembly 230 to prevent premature movement of the outer assembly 200 with respect to the inner assembly 100. The outer assembly 200 extends from the second end 12 of the DBSM 10 and terminates at a distance from the first end 11 of the DBSM 10, i.e. there is a substantial overlap between the inner and outer assemblies 100, 200, with a substantial portion of inner assembly 100 located in the outer assembly 200.

Figure 5:
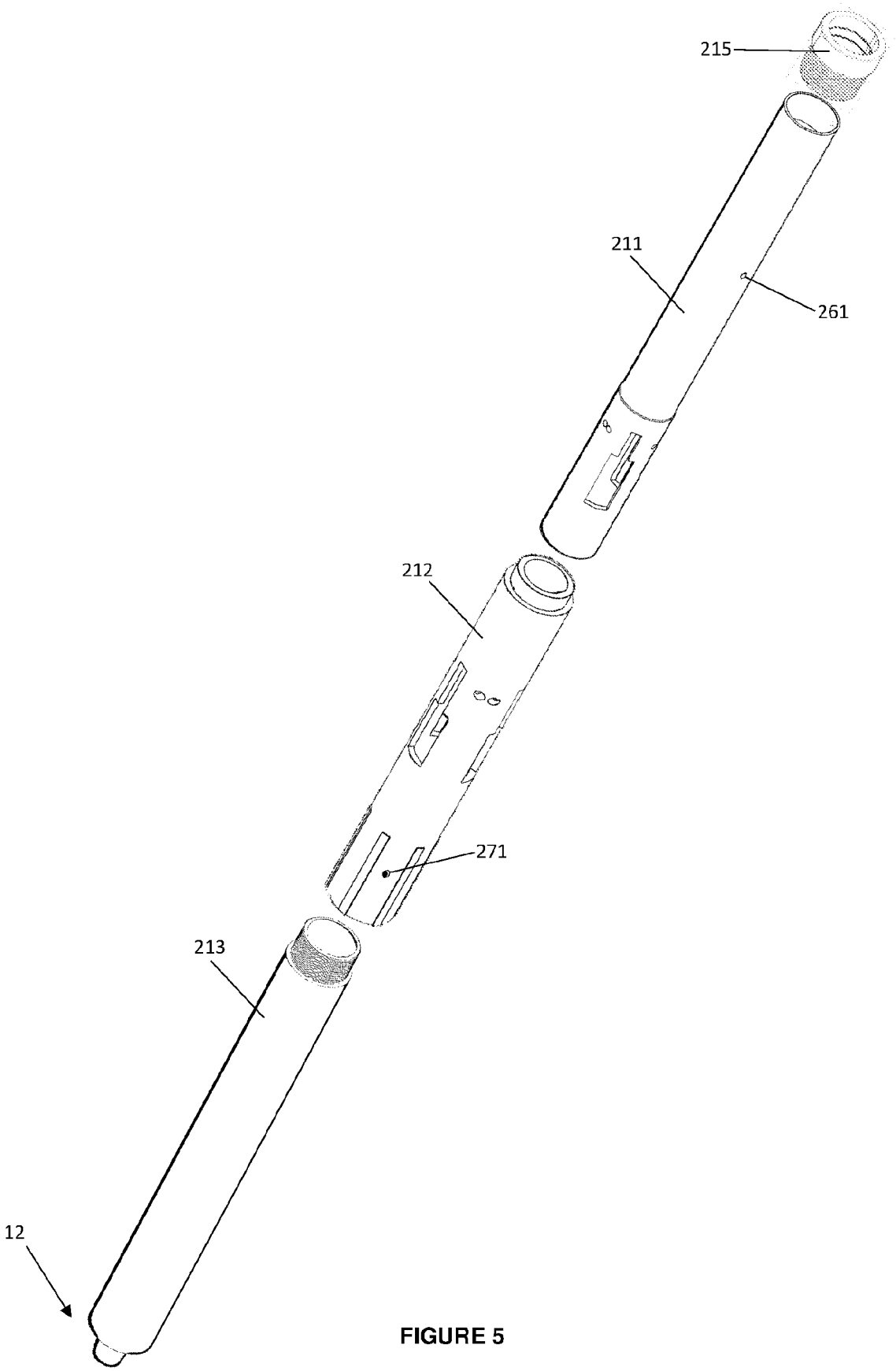
FIG. 5 illustrates an exploded view of the outer housing of the milling tool shown in FIG. 1.

FIG. 5 illustrates an exploded view of the outer housing 210. The outer housing 210 of the outer assembly 200 is hollow and comprises a first portion 211, a middle portion 212 and a second portion 213. An end of the first portion 211 that is proximate to the first end 11 of the DBSM 10 is connected to a debris cap 215, with the other end of the first portion 211 being connected to an end of the middle portion 212. The other end of the middle portion 212 (that is not connected to the first portion 211) is connected to an end of the second portion 213. The other end of the second portion 213 (that is not connected to the middle portion 212) forms the second end 12 of the DBSM 10. However, in further embodiments, the outer housing 210 may comprise only two or four or more portions connected to each other or the outer housing 210 may be integrally formed.

The first portion 211 of the outer housing 210 includes a plurality of cut-outs for the cut-out blades 240 to extend radially outwards from the first portion 211 of the outer housing 210 of the DBSM 10. Each cut-out is located adjacent to one of the cut-out blades 240 and is sized such that a portion of each cut-out blade 240 can extend outwardly through the cut-out.

The first portion 211 of the outer housing 210 encases the J-slot portion 111 of the first mandrel 110 and includes an internal lug extending radially inwards from the inner wall of the first portion 211, with the lug engaging with the recess (J-slot) of the J-slot portion 111. The mating of the internal lug of the first portion 211 of the outer housing 210 with the recess of the J-slot portion 111 of the first mandrel 110 allows for rotational torque to be transmitted to the outer assembly 200 from the inner assembly 100, i.e. the outer assembly 200 can be rotated by rotating the inner assembly 100.

The piston assembly 220 extends through the first portion 211 of the outer housing 210 and includes a wedge rod 221, a piston head 222 connected to a proximal end of the wedge rod 221 and a compression spring 223 located between the wedge rod 221 and the piston head 222. The wedge rod 221 is in the shape of a hollow cylinder and has a hollow central tubular portion, with the second mandrel 130 extending through the hollow portion of the wedge rod 221.

The wedge rod 221 has a projection located at a distal end of the wedge rod 221 and extending radially outwards from the wall of the wedge rod 221. The projection extends circumferentially along the wall of the wedge rod 221 and has a trapezoidal cross-sectional shape. The projection of the wedge rod 221 aligns with the distal portions of the cut-out blades 240 such that movement of the wedge rod 221 relative to the first portion 211 of the outer housing 210 results in the cut-out blades 240 pivoting radially outwards from the first portion 211 through the cut-outs of the first portion 211.

The wedge rod 221 is connected to the piston head 222 at the proximal end of the wedge rod 221 (i.e. the end which is opposite to the end with the projection). The spring 223 extends around the wedge rod 221, between the piston head 222 and a third annular projection (described further below) extending inwardly from an internal wall of the first portion 211, i.e. the wedge rod 221 extends through the central cavity of the spring 223 along its longitudinal axis.

The piston head 222 has a hollow cylindrical body with a first end facing the first end 11 of the DBSM 10 and a second end facing the second 12 of the DBSM 10, with the second mandrel 130 extending through the piston head 222 from the first to second end. The opening at a proximal end of the piston head 222 is sized such that no fluid can flow through the opening while the second mandrel 130 extends through it (except the fluid flowing through the second mandrel 130 itself). The opening at a distal end of the piston head 222 is slightly and relatively larger than the opening at the proximal end of the piston head 222 to allow for engagement with the proximal end of the wedge rod 221.

The first portion 211 of the outer housing 210 includes first, second and third annular projections extending inwardly from an internal wall of the first portion 211, the first, second and third annular projections being spaced from each other along a longitudinal axis 15 of the DBSM 10. The first annular projection is located adjacent the connection sleeve 120 and sealingly engages with the outer surface of the connection sleeve 120. A seal, in the form of a high-pressure sealing ring, is located between the first annular projection and the outer surface of the connection sleeve 120, thereby forming a sealed pressure chamber 260 defined by the space enclosed by the first annular projection and the first end of the piston head 222. The plurality of apertures 121 of the connection sleeve 120 allow drilling fluid to flow into the pressure chamber 260 from the connection sleeve 120.

The second annular projection is located between the piston head 222 and the third annular projection. The second annular projection extends around the spring 223, but is spaced from the spring 223 in a direction transverse to the longitudinal axis 15 to avoid obstructing the spring during compression or decompression. The location of the second annular projection is selected so as to define a maximum travelling distance for the piston head 222 toward the second end 12 of the DBSM 10, i.e. the second annular projection prevents the piston head 222 from moving any further, beyond the second annular projection, towards the second end 12 of the DBSM 10.

The third annular projection is located between the spring 223 and the cut-out blades 240, with the third annular projection supporting a distal end of the spring 223, while a proximal end of the spring 223 is connected to the piston head 222. The third annular projection effectively holds the distal end of the spring 223 at a fixed location relative to the outer housing 210, thereby allowing the spring 223 to be compressed by the movement of the piston head 222 toward the second end 12 of the DBSM 10. The central aperture of the third annular projection is sized to allow the wedge rod 221 to extend therethrough.

The first portion 211 of the outer housing 210 also includes two apertures 261 (visible in FIG. 5) in the form of nozzles configured to allow drilling fluid in the pressure chamber 260 to flow out of the pressure chamber 260 and the first portion 211. The apertures 261 are spaced from each other along the wall of the first portion 211 and located on opposite sides of the pressure chamber 260. However, in further embodiments, the first portion 211 may include only one or three or more apertures and/or the apertures may be located elsewhere on the first portion 211 or the outer housing 210. The apertures 261 are configured to direct the flow of drilling fluid towards the first end 11 of the DBSM 10 to disperse swarf and/or debris formed while the cut-out blades 240 are milling/cutting the inner string of a wellbore to form a starter window.

Although only two cut-out blades 240 are visible in FIGS. 1-3, the DBSM 10 includes three cut-out blades 240 that are equally radially spaced from each other, with the cut-out blades 240 being pivotally connected to the first portion 211 of the outer housing 210 at points that lie in a common plane that is transverse to the longitudinal axis 15 of the DBSM 10. However, in further embodiments, the DBSM 10 may include only one, two or four or more cut-out blades 240.

Figure 6:
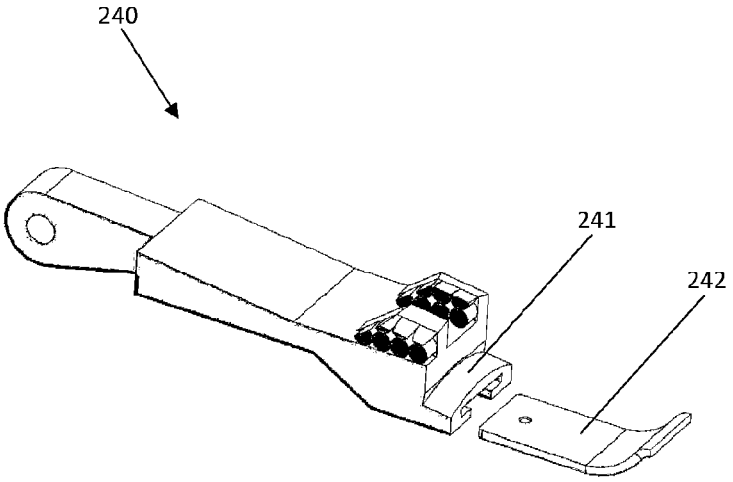
FIG. 6 illustrates an exploded perspective view of the cut-out blade of the milling tool shown in FIG. 1.

FIG. 6 illustrates a cut-out blade 240 installed in the DBSM 10. The distal portion of each cut-out blade 240 includes a plurality of cutting elements. Any cutting elements suitable for milling/removing cement and drilling formation may be utilized including, but not limited to, polycrystalline diamond cutter (PDC) inserts, thermally stabilized polycrystal line (TSP) inserts, diamond inserts, glyphaloy carbide inserts, boron nitride inserts, abrasive materials, and other cutting elements known to those skilled in the art. However, in further embodiments, the cutting elements may be located elsewhere on the cut-out blades 240, for example, along the entire length of each cut-out blade 240.

The distal portion of each cut-out blade 240 also includes a stop member 241, in the form of a projection extending outwardly and beyond the plurality of cutting elements, and a leaf spring 242 connected to the stop member. The stop member 241 is sized such that it obstructs the pivotal movement of the respective cut-out blade 240 beyond a predetermined position by abutting an edge of the respective cut-out in the first portion 211 of the outer housing 210, i.e. the stop members 241 restrict the extension of the cut-out blades 240 from the outer housing 210 to maintain a desired diameter of the circular cutting path followed by the plurality of cutting elements of the cut-out blades 240 when the DBSM 10 is being rotated.

The leaf spring 242 of each cut-out blade 240 is partially arcuate in shape and removably connected to the stop member 241. The leaf spring 242 is sized and configured such that, when the respective cut-out blade 240 is extended due to engagement with the projection of the wedge rod 221, and the stop member 241 abuts an edge of the respective cut-out in the first portion 211, the leaf spring 242 is compressed as it is pushed against the wall of the first portion 211 of the outer housing 210. Thus, when the wedge rod 211 moves back towards the first end 11 of the DBSM 10 and the projection of the wedge rod 211 disengages with the cut-out blades 240, the tension in the compressed leaf springs 242 enables the cut-out blades 240 to retract into the first portion 211 of the outer housing 210.

The cut-out blades 240 are connected to the first portion 211 of the outer housing 210 via retaining pins 243 located through apertures (visible in FIG. 5) formed in the wall of the first portion 211, with the cut-out blades 240 pivoting about the retaining pins 243 when extended. The apertures for the retaining pins 243 extend from the internal surface of the first portion 211 to the outer surface of the first portion 211, thereby allowing the retaining pins 243 to be accessible from an exterior of the outer housing 210 for maintenance or replacement. Easy access to the retaining pins 243 also allows for worn or damaged cut-out blades 240 to be replaced easily by removing the retaining pin 243, replacing the cut-out blade 240 and re-inserting the retaining pin 243.

The outer surface of the middle portion 212 includes a plurality of linear projections located proximate the distal end of the middle portion 212 (the end that is connected to the second portion 213), the linear projections extending parallel to the longitudinal axis 15 of the DBSM 10. The linear projections of the middle portion 212 are transversely spaced from each other and extend radially outwards from the outer surface of the middle portion 212, thereby acting as stabilizing fins to stabilize and centralize the DBSM 10 when it is being rotated in use.

Similar to the first portion 211, the middle portion 212 of the outer housing 210 includes a plurality of cut-outs for the milling blades 250 to extend radially outwards from the middle portion 212. Each cut-out is located adjacent to one of the milling blades 250 and is sized such that a portion of each milling blade 250 can extend outwardly through the cut-out.

Although only two milling blades 250 are visible in FIGS. 1-3, the DBSM 10 includes three milling blades 250 that are equally radially spaced from each other, with the milling blades 250 being pivotally connected to the middle portion 212 of the outer housing 210 at points that lie in a common plane that is transverse to the longitudinal axis 15 of the DBSM 10. However, in further embodiments, the DBSM 10 may include only one, two or four or more milling blades 250.

Figure 7:
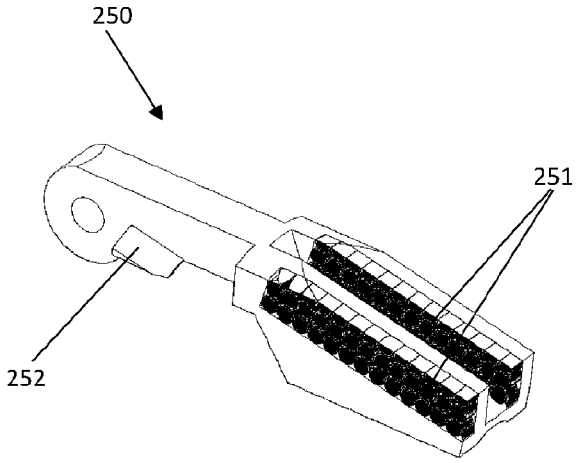
FIG. 7 illustrates a perspective view of the milling blade of the milling tool shown in FIG. 1.

FIG. 7 illustrates a milling blade 250 installed in the DBSM 10. The distal portion of each milling blade 250 includes a plurality of cutting elements 251. Any cutting elements suitable for milling/removing cement and drilling formation may be utilized including, but not limited to, polycrystalline diamond cutter (PDC) inserts, thermally stabilized polycrystal line (TSP) inserts, diamond inserts, glyphaloy carbide inserts, boron nitride inserts, abrasive materials, and other cutting elements known to those skilled in the art. However, in further embodiments, the cutting elements 251 may be located elsewhere on the milling blades 250, for example, along the entire length of each milling blade 250.

Each milling blade 250 also includes two stop members 252 in the form of laterally extending projections. The stop members 252 extend outwardly from opposite sides of the respective milling blade 250 (one stop member 252 on each side) and are located adjacent a proximal end of the milling blade 250. However, in further embodiments, each milling blade may include only one or three or more stop members 252. Moreover, in further embodiments, the stop members 252 may be located elsewhere on the milling blade 250, for example, at a distal end thereof.

The stop members 252 are sized such that they obstruct the pivotal movement of the respective milling blade 250 beyond a predetermined position by abutting opposite edges of the respective cut-out in the middle portion 212 of the outer housing 210, i.e. the stop members 252 restrict the extension of the milling blades 250 from the outer housing 210 to maintain a desired diameter of the circular cutting path followed by the plurality of cutting elements 251 of the milling blades 250 when the DBSM 10 is being rotated.

The milling blades 250 are connected to the middle portion 212 of the outer housing 210 via retaining pins 253 located through apertures (visible in FIG. 5) formed in the wall of the middle portion 212, with the milling blades 250 pivoting about the retaining pins 253 when extended. The apertures for the retaining pins 253 extend from the internal surface of the middle portion 212 to the outer surface of the middle portion 212, thereby allowing the retaining pins 253 to be accessible from an exterior of the outer housing 210 for maintenance or replacement. Easy access to the retaining pins 253 also allows for worn or damaged milling blades 250 to be replaced easily by removing the retaining pin 253, replacing the milling blade 250 and re-inserting the retaining pin 253.

A substantial portion of the third mandrel 140 extends through the middle portion 212 of the outer housing 210 and includes a projection located adjacent the distal end of the third mandrel 140, the projection extending radially outwards from the wall of the third mandrel 140. The projection extends circumferentially along the wall of the third mandrel 140 and has a trapezoidal cross-sectional shape. The projection of the third mandrel 140 aligns with the distal portions of the milling blades 250 such that movement of the third mandrel 140 relative to the middle portion 212 of the outer housing 210 results in the milling blades 250 pivoting radially outwards from the middle portion 212 through the cut-outs of the middle portion 212.

The second portion 213 of the outer housing 210 has a first section, a second section (at the second end 12 of the DBSM 10) and an intermediate section located between the first and second sections. The internal diameter of the first section is greater than the internal diameter of the second section, with the internal diameter of the intermediate section tapering from the internal diameter of the first section to the internal diameter of the second section. The first section of the second portion 213 of the outer housing 210 forms the pressure chamber 270 into which the drilling fluid flows as it exits the distal end of the third mandrel 140.

A plate 218 is located at the junction of the first and intermediate sections of the second portion 213. The plate 218 is disc-shaped with a plurality of apertures formed through the plate 218 such that the drilling fluid can flow through the apertures from first section to the second section of the second portion 213 of the outer housing 210.

The middle portion 212 of the outer housing 210 includes three apertures 271 (visible in FIG. 5) in the form of nozzles configured to allow drilling fluid in the pressure chamber 270 to flow out of the pressure chamber 270 and the middle portion 212. The apertures 271 are spaced from each other along the wall of the middle portion 271 with each aperture located between two adjacent linear projections of the plurality of linear projections located at the distal end of the middle portion 212. However, in further embodiments, the middle portion 212 may include only one, two or four or more apertures and/or the apertures may be located elsewhere on the middle portion 212 or the outer housing 210. The apertures 271 are configured to direct the flow of drilling fluid towards the first end 11 of the DBSM 10 to disperse swarf and/or debris formed while the milling blades 250 are milling/cutting the inner string of a wellbore to form a full-length/complete window.

Figures 8A, 8B:
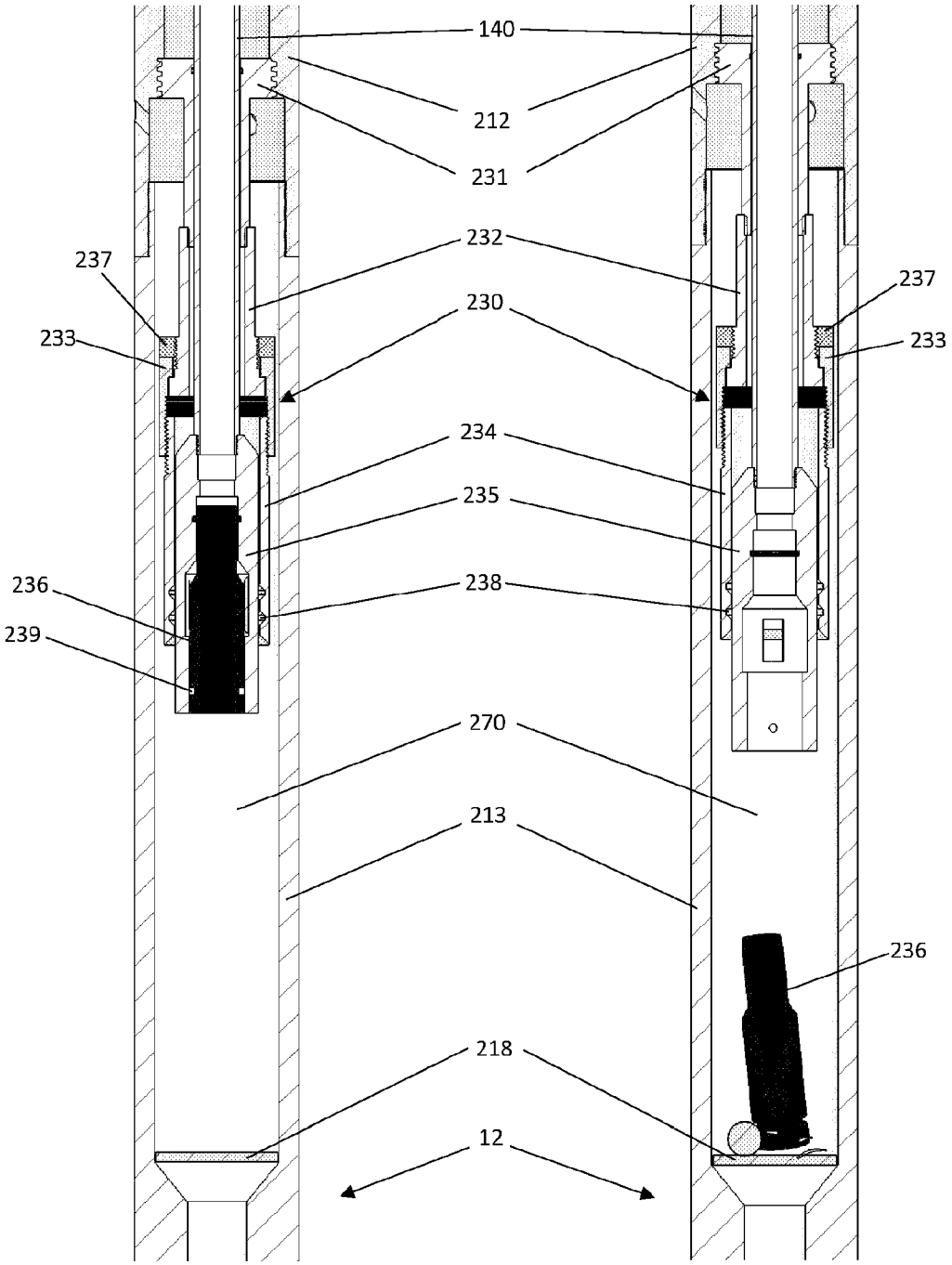
FIG. 8*a* illustrates a cross-sectional view of the shear assembly of the milling tool shown in FIG. 1 prior to the disconnect sleeve being disconnected.
FIG. 8*b* illustrates a cross-sectional view of the shear assembly of the milling tool shown in FIG. 1 with the disconnect sleeve disconnected.
Figure 9:
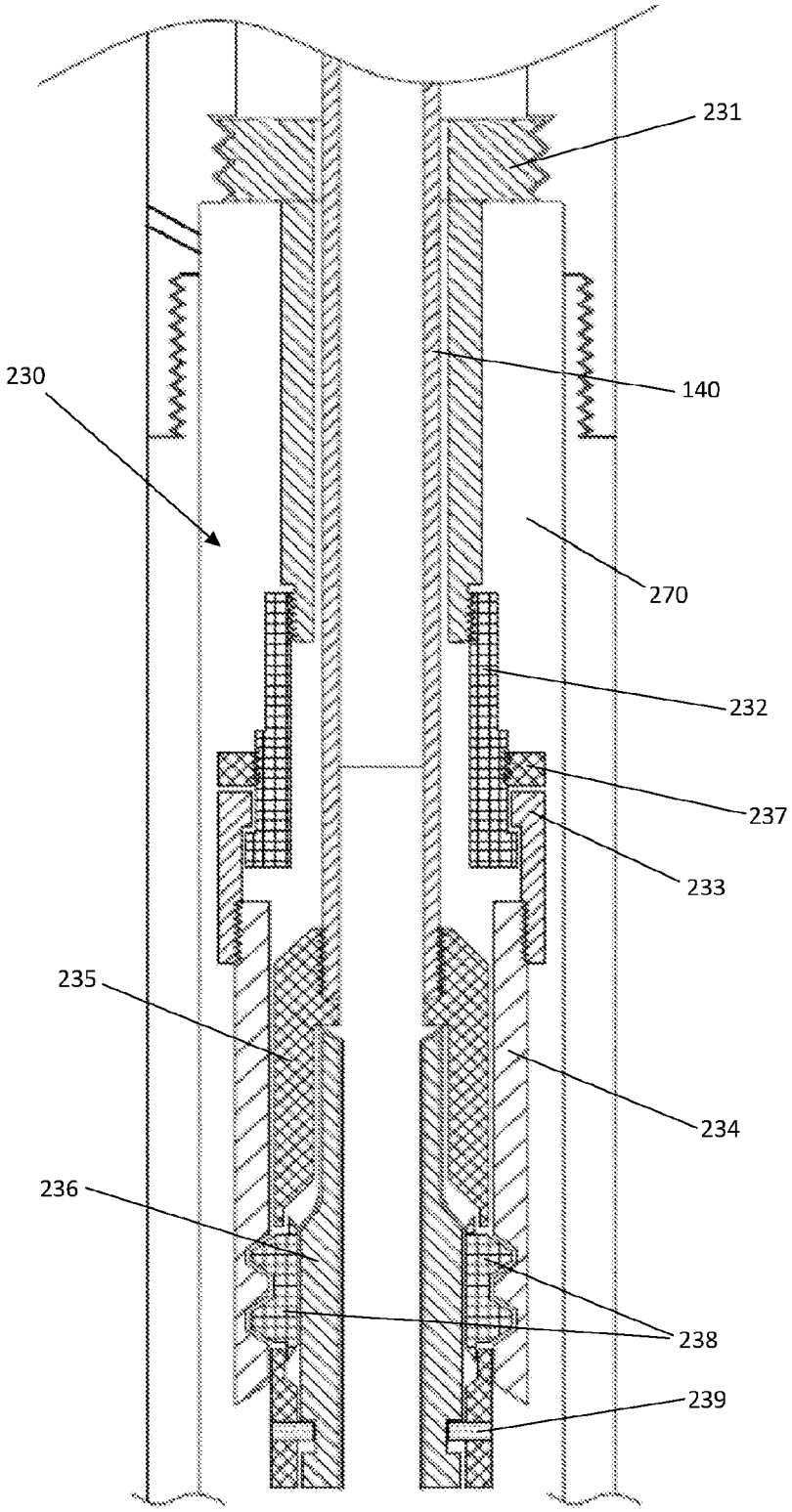
FIG. 9 illustrates a further cross-sectional view of the shear assembly of the milling tool shown in FIG. 1.

FIGS. 8*a*, 8*b* and 9 illustrate the shear assembly 230 in greater detail. The shear assembly 230 comprises a shear sleeve 231 (in the form of an outer disconnect anchor member), a shoulder member 232, an adjustment collar 233, an outer disconnect member 234, an inner disconnect member 235 and a disconnect sleeve 236. The shear sleeve 231 is connected to the end of the middle portion 212 of the outer housing 210 and extends towards the second end 212 of the DBSM 10, through the second portion 213. The shear sleeve 231 has a hollow cylindrical body with the third mandrel 140 extending therethrough. The other end of the shear sleeve 231 (that is not connected to the middle portion 212) is threadingly connected to an end of the shoulder member 232. The shoulder member 232 has a hollow cylindrical body with the third mandrel 140 extending therethrough and an internal diameter that is greater than the internal diameter of the shear sleeve 231. The other end of the shoulder member 232 (that is not connected to the shear sleeve 231) has an annular flange extending radially outwards that engages with and supports a corresponding radial flange (that extends radially inwards) located at an end of the adjustment collar 233. The shoulder member 232 also has an intermediate threaded portion that threadingly engages with a locking ring 237. The locking ring 237 can be used to tighten the engagement of the flanges of the shoulder member 232 and the adjustment collar 233 with each other.

The adjustment collar 233 has a hollow cylindrical body with an internal diameter that is greater than the internal diameter of the shoulder member 232. The other end of the adjustment collar 233 (which is not engaged with the shoulder member 232) is threadingly connected to an end of the outer disconnect member 234.

The outer disconnect member 234 also has a hollow cylindrical body with an external diameter that is less than the internal diameter of the adjustment collar 233, and an internal diameter than is greater than the internal diameter of the shoulder member 232. The other end of the outer disconnect member 234 (that is not connected to the adjustment collar 233) includes two annular recesses located on the inner wall of the outer disconnect member 234, with the recesses being spaced from each other and shaped to engage with radially outwardly extending projections of three locking members 238 located between the outer disconnect member 234 and the disconnect sleeve 236.

The inner disconnect member 235 has a hollow cylindrical body with an external diameter that is less than the internal diameter of the outer disconnect member 234. The inner disconnect member 235 is located inside the outer disconnect member 234 with an end of the inner disconnect member 235 being threadingly connected to the distal end of the third mandrel 140. An annular flange extending radially inwards is formed at a point on the inner wall of the inner disconnect member 235 immediately below the distal end of the third mandrel 140. The inner disconnect member 235 also includes three cut-outs formed on the body for the projections of the locking members 238 to extend through. However, in further embodiments, the inner disconnect member 235 may have only one, two or four or more cut-outs, depending on the number of locking members 238.

The other end of the inner disconnect member 235 (that is not connected to the third mandrel 140) includes four apertures for a portion of shearing pins 239 to extend through. A portion of each of the shearing pins 239 also extends through an external annular recess provided at an end of the disconnect sleeve 236. However, in further embodiments, any number of shear pins 239 (and corresponding number of apertures in the inner disconnect member 235) and/or locking members 238 (and corresponding number of cut-outs in the inner disconnect member 235) may be used.

Each locking member 238 has a base with an arcuate cross-sectional shape and two projections extending radially outwards from the base. The projections of each locking member 238 extend through their respective cut-out in the inner disconnect member 235 to engage with the recesses formed in the outer disconnect member 234. Further, a portion of the base of each locking member 238 extends beyond the respective cut-out in the inner disconnect member 235 to engage with the inner disconnect member 235. The base of each locking member 238 is also in contact with the outer surface of the disconnect sleeve 236.

The disconnect sleeve 236 has a hollow cylindrical body with an internal diameter that is slightly less than the internal diameter of the third mandrel 140. The disconnect sleeve 236 is located inside the inner disconnect member 235 and is held in place by the locking members 238 (by compressive force exerted onto the disconnect sleeve 236 by the locking members 238). Movement of the disconnect sleeve 236 relative to the inner disconnect member 235 is further restricted by the shear pins 239. The disconnect sleeve 236 disengages from the inner disconnect member 235 only when the shear pins 239 have been sheared due to application of force. An O-ring (not shown) is located between the disconnect sleeve 236 and the inner disconnect member 235, with the O-ring preventing the drilling fluid from flowing into the annular space between the disconnect sleeve 236 and the inner disconnect member 235, thereby maintaining the fluid pressure and preventing any undesirable damage to the components of the shear assembly 230.

Figure 10:
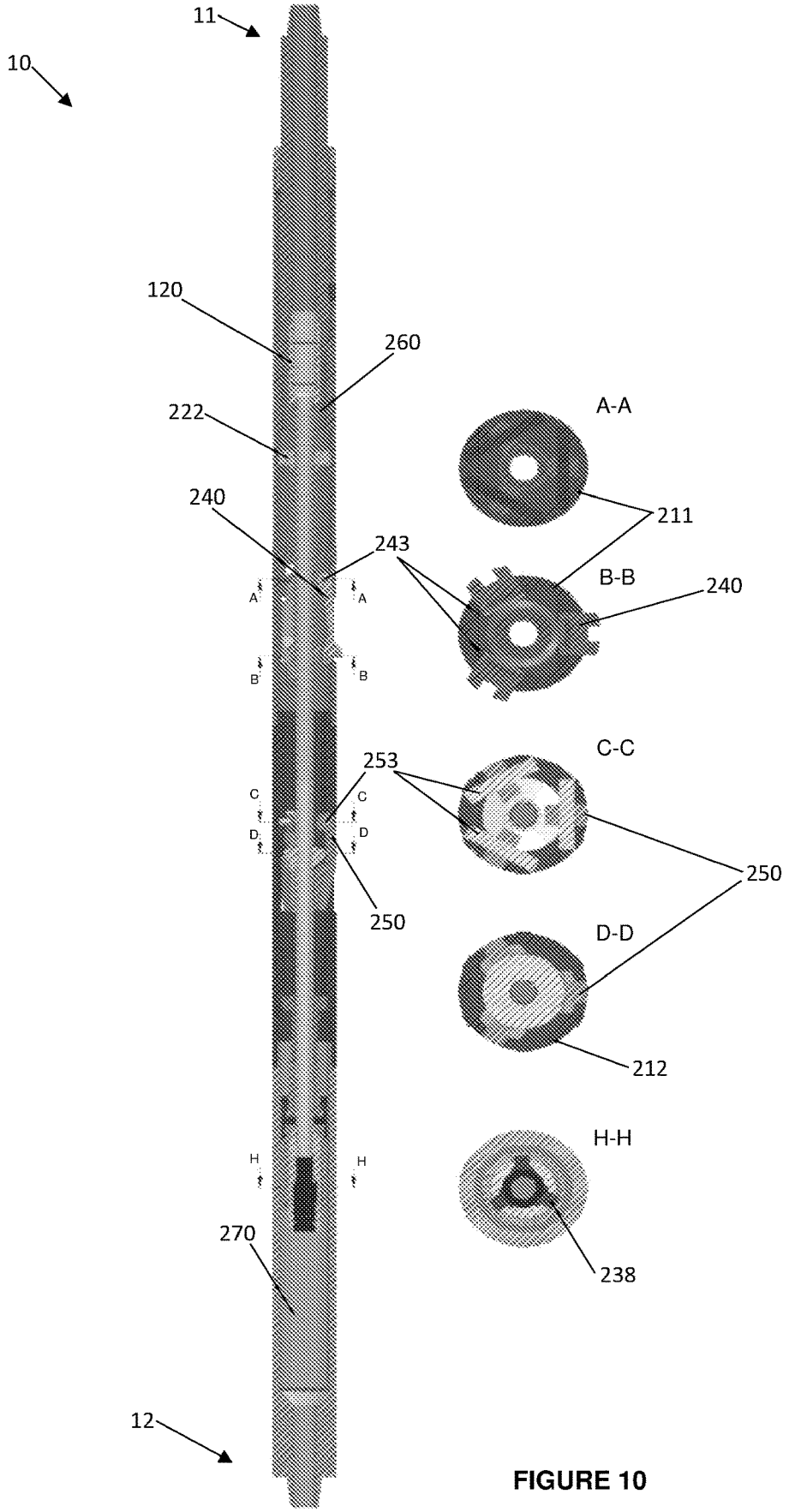
FIG. 10 illustrates a cross-sectional view and multiple transverse cross-sectional views of the milling tool shown in FIG. 1 with the cut-out blades extended.

In FIG. 10, transverse cross-section A-A taken along 'A-A' shows the proximal portions of the cut-out blades 240 connected to the first portion 211 of the outer housing 210. Transverse cross-section B-B taken along 'B-B' shows the distal portions of the cut-out blades 240 extending from the first portion 211 of the outer housing 210. Transverse cross-section C-C taken along 'C-C' shows the proximal portions of the milling blades 250 connected to the middle portion 212 of the outer housing 210. Transverse cross-section D-D taken along 'D-D' shows the projection of the third mandrel 140 and the milling blades 250. Transverse cross-section H-H taken along 'H-H' shows some of the components of the shear assembly 230 (outer disconnect member 234, an inner disconnect member 235, disconnect sleeve 236 and locking members 238) located within the second portion 213 of the outer housing 3210.

Figure 11:
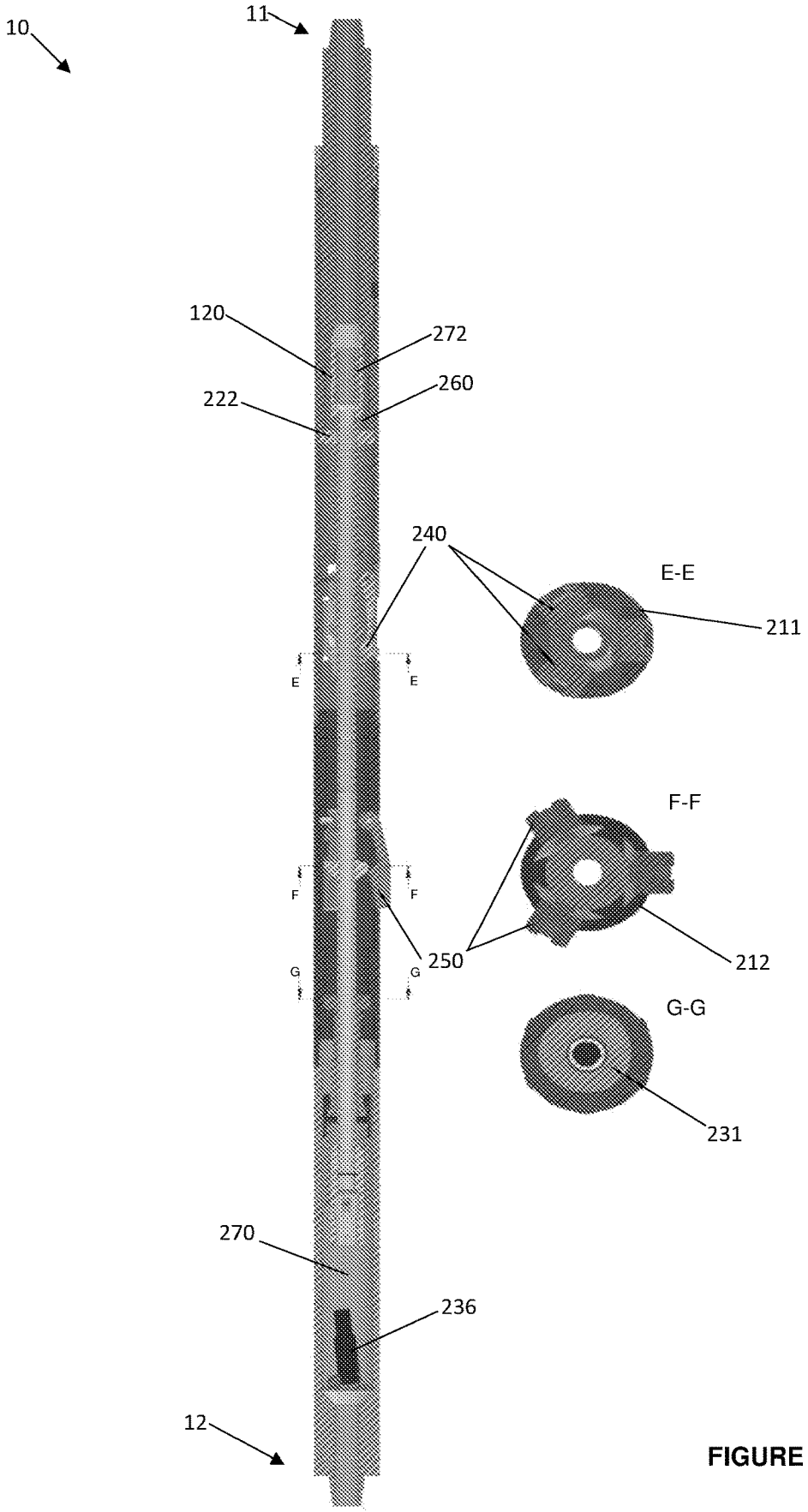
FIG. 11 illustrates a cross-sectional view and multiple transverse cross-sectional views of the milling tool shown in FIG. 1 with the milling blades extended.

In FIG. 11, transverse cross-section E-E taken along 'E-E' shows the distal portions of the cut-out blades 240 located entirely within the first portion 211 of the outer housing 210. Transverse cross-section F-F taken along 'F-F' shows the distal portions of the milling blades 250 extending from the middle portion 212 of the outer housing 210, and transverse cross-section G-G taken along 'G-G' shows the shear sleeve 231 connected to the middle portion 212 of the outer housing 210.

The milling tool (DBSM 10) is used to cut/mill a starter window (a circumferential cut along a length of the string), and subsequently a complete/full-length window, in an inner casing string of a dual-string wellbore, without damaging the outer casing string. To mill a starter window in the inner casing string of a wellbore, the DBSM 10 is inserted (with the second end 12 as the leading end) into the wellbore, with the DBSM 10 being in a first closed position in which the cut-out blades 240 and the milling blades 250 are located entirely inside the outer housing 210 (as shown in FIG. 1).

The DBSM 10 is first located at a point in the wellbore such that the cut-out blades 240 align with the desired location of the starter window. Next, rotation of the DBSM 10 is commenced by applying rotational torque to the first mandrel 110 which causes the outer assembly 200 (including the cut-out blades 240) to rotate and the drilling fluid is then pumped into the DBSM 10 through the first end 11 and into the pressure chamber 270 located in the second portion 213 of the outer housing 210 (via the first mandrel 110, the connection sleeve 120 and the second and third mandrels 130, 140). As the drilling fluid flows through the connection sleeve 120, a portion of the drilling fluid also flows out of the connection sleeve 120, via the plurality of apertures 121, into the sealed pressure chamber 260 located in the first portion 211 of the outer housing 210, which leads to build-up of hydraulic pressure inside the pressure chamber 260. The hydraulic pressure exerts a force on the first end of the piston head 222 causing it to move towards the second end 12 of the DBSM 10. The movement of the piston head 222 also causes the wedge rod 221 to move relative to the outer housing 210 and the cut-out blades 240, towards the second end 12 of the DBSM 10. The movement of the wedge rod 221 results in the projection of the wedge rod 221 engaging with the cut-out blades 240 and causing the cut-out blades 240 to extend and pivot radially outwards through the cut-outs in the first portion 211 of the outer housing 210.

However, the extension of the cut-out blades 240 is controlled and limited by the stop members 241 abutting an edge of the cut-outs in the first portion 211 of the outer housing 210, i.e. only a desired portion of each of the cut-out blades 240 extends out of the outer housing 210. With the cut-out blades 240 extended, the DBSM 10 is considered to have moved from a first closed position to a first open position (as shown in FIGS. 2 and 10).

With the DBSM 10 rotating in the first open position, the cut-out blades 240 cut/mill a starter window in the inner casing string and the depth of the starter window can be controlled by lowering the DBSM 10 into the wellbore accordingly.

When the starter window in the inner casing string has been formed as per desired requirements, circulation of the drilling fluid pressure is paused and the spring 223 causes the piston head 222 to move back towards the first end 11 of the DBMS 10. This causes the wedge rod 221 to move back towards the first end 11 of the DBSM 10. Without the projection of the wedge rod 221 engaging with the cut-out blades 240, the cut-out blades 240 retract into the first portion 211 of the outer housing 210 due to the forces exerted by the compressed leaf springs 242.

Next, the functionality of extending the cut-out blades 240 is deactivated by dropping an isolation tube 272 (visible in FIGS. 3 and 11) into the first mandrel 110 from the first end 11 of the DBSM 10. The isolation tube 272 is a hollow cylindrical tube with an outer diameter that is marginally less than the inner diameter of the connection sleeve 120. Both end portions of the isolation tube 272 engage with seals located on the inner surface of the connection sleeve 120, thereby isolating the apertures 121 of the connection sleeve 120 and preventing drilling fluid from flowing into the pressure chamber 260 from the connection sleeve 120. The engagement of the isolation tube 272 with the seals in the connection sleeve 120 can be confirmed by observing an increased circulating pressure for the same flow rate as prior to dropping the isolation tube 272 into the first mandrel 110, as drilling fluid is no longer able to flow out of the apertures 121 of the connection sleeve 120 and then out of the pressure chamber 260 via the apertures 261.

The isolation tube 272 travels along the first mandrel 110 until it reaches the connection sleeve 120. When the isolation tube 272 is located in the connection sleeve 120, the cut-out blades 240 cannot be extended again despite an increase in the drilling fluid pressure, as the hydraulic pressure inside the pressure chamber 260 would not increase due to the isolated apertures 121 of the connection sleeve 120. With the cut-out blades 240 and the milling blades 250 retracted and the isolation tube located in the connection sleeve 120, the DBSM 10 is considered to have moved from the first open position to a second closed position.

Next, the DBSM 10 is positioned in the wellbore such that the milling blades 250 align with an upper end of the starter window formed by the cut-out blades 240. To move the DBSM 10 to the second open position (with the milling blades 250 extended) from the second closed position, a shear ball is dropped into the first, second and third mandrels 110, 130, 140 from the first end 11 of the DBSM 10. The shear ball travels along the third mandrel 140 until it reaches the inner disconnect member 235. The inner diameter of the inner disconnect member 235 is chosen such that further movement of the shear ball towards the second end 12 of the DBSM 10 is prevented. The drilling fluid circulated through the first, second and third mandrels 110, 130, 140 applies hydraulic pressure on the shear ball and causes the shear pins 239 to shear due to build-up of pressure in the third mandrel 140. The inner disconnect member 235, the shear pins 239 and the locking members 238 drop into the pressure chamber 270 onto the plate 218. The shearing of the shear pins 239 results in a pressure drop of the fluid (which is observed to provide indication of shearing of the shear pins 239) as the fluid flows into the pressure chamber 270 instead of being obstructed by the shear ball.

With the locking members 238 disengaged from the outer disconnect member 234 and the inner disconnect member 235, the inner disconnect member 235 is free to move relative to the outer disconnect member 234, which allows the outer assembly to move relative to the inner assembly to move the DBSM 10 to the second open position.

To extend the milling blades 250, the pressure of the drilling fluid is increased. As the drilling fluid flows through the third mandrel 140 and into the sealed pressure chamber 270 located in the second portion 213 of the outer housing 210, there is a build-up of hydraulic pressure inside the pressure chamber 270. The hydraulic pressure exerts a force on the proximal end of the shear sleeve 231 that is connected to outer housing 210, causing the outer housing 210 to move relative to the inner assembly 100 towards the first end 11 of the DBSM 10. As the outer housing 210 moves towards the first end 11 of the DBSM 10, the milling blades 250 connected to the outer housing 210 also move towards the first end 11 relative to the inner assembly 100. The movement of the milling blades results in the projection of the third mandrel 140 engaging with the milling blades 250 and causing the milling blades 250 to extend and pivot radially outwards through the cut-outs in the middle portion 212 of the outer housing 210.

However, the extension of the milling blades 250 is controlled and limited by the stop members 252 abutting opposite edges of the cut-outs in the middle portion 212 of the outer housing 210, i.e. only a desired portion of each of the milling blades 250 extends out of the outer housing 210. With the milling blades 250 extended, the DBSM 10 is considered to have moved from the second closed position to the second open position (as shown in FIGS. 3 and 11).

Rotation of the DBSM 10 is commenced when it is in the second open position to form the full-length/complete window. Once it has been determined that the full-length/complete window in the inner casing string has been formed, the circulation of drilling fluid and rotation of the DBSM 10 is stopped. As the fluid pressure in the pressure chamber 270 drops, the shear sleeve 231 and the remaining the outer assembly 200 move towards the second end 12 of the DBSM 10 resulting in the milling blades 250 being retracted completely into the outer housing 210 and the DBSM 10 moving back to the second closed position.

The milling tool (DBSM 10) provides several advantages over similar known milling tools. The DBSM 10 is capable of forming a starter window in the inner casing string, as well as a full-length/complete window in the inner casing string, without requiring the DBSM 10 to be retracted from the wellbore to change/replace blades. Further, the stop members 241 of the cut-out blades 240 and the stop members 252 of the milling blades 250 allow the extension of the blades to be controlled such that the blades do not extend beyond a predetermined position, thereby preventing any damage to the outer casing string while forming the starter and full-length/complete window in the inner casing string. Moreover, the configuration of the DBSM 10 in the second closed position prevents the cut-out blades 240 from being extended despite increasing the drilling fluid pressure.

The configuration and design of the shear assembly 230 prevents premature shearing of the shearing pins 239 (due to shock loads or rotational stress experienced during drilling operation) by transferring and applying the loads to the locking member 238 instead of the shearing pins 239, thereby isolating the shearing pins from any loads or stresses.

In this specification, adjectives such as first and second, forward and backward, upward and downward, top and bottom, proximal and distal, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The invention claimed is:

1. A milling tool for cutting an inner casing string of a wellbore, the milling tool comprising:

a tool body;

an extendable cut-out blade located in the tool body and configured to cut the inner casing string to form a starter window; and an extendable milling blade located in the tool body and configured to cut the inner casing string to form a full-length window, wherein the milling blade is configured to extend from the tool body independently from the cut-out blade, wherein the cut-out blade and the milling blade are configured to extend from the tool body by circulating drilling fluid through the milling tool, and wherein the milling tool is movable between (i) a first closed position where the cut-out blade and the milling blade are not extended from the tool body, (ii) a first open position where the cut-out blade is extended and the milling blade is not extended from the tool body, and (iii) a second open position where the milling blade is extended and the cut-out blade is not extended from the tool body.

2. The milling tool of claim 1, wherein the milling tool is a dual blade section mill.

3. The milling tool of claim 1, wherein the tool body has an inner assembly and an outer assembly, the outer assembly being slidable relative to the inner assembly.

4. The milling tool of claim 3, wherein the outer assembly includes an outer housing comprising a first portion, a middle portion and a second portion, the first portion of the outer housing including a cut-out for the cut-out blade to extend through.

5. The milling tool of claim 4, wherein the middle portion of the outer housing includes a cut-out for the milling blade to extend through.

6. The milling tool of claim 5, wherein the outer assembly includes a piston assembly for extending the cut-out blades.

7. The milling tool of claim 6, wherein the first portion of the outer housing includes a first annular projection extending inwardly from an internal wall of the first portion, and wherein a space enclosed by the first annular projection and a first end of a piston head of the piston assembly forms a pressure chamber.

8. The milling tool of claim 7, wherein the first portion of the outer housing includes at least two apertures configured to allow drilling fluid in the pressure chamber of the first portion to flow out of the pressure chamber.

9. The milling tool of claim 1, wherein a distal portion of the cut-out blade includes a stop member and a spring connected to and extending from the stop member, the stop member being sized such that it obstructs movement of the cut-out blade beyond a predetermined position.

10. The milling tool of claim 1, wherein the milling blade further includes at least one stop member configured to obstruct movement of the milling blade beyond a predetermined position.

11. The milling tool of claim 1, wherein the milling tool further comprises a shear assembly.

12. The milling tool of claim 11, wherein the shear assembly includes:

a shear sleeve;

an outer disconnect member operatively connected to the shear sleeve;

an inner disconnect member releasably engaged with the outer disconnect member; and a disconnect sleeve releasably engaged with the inner disconnect member.

13. The milling tool of claim 12, wherein the shear assembly further includes a shear pin engaged with the inner disconnect member and the disconnect sleeve, the shear pin configured to prevent disengagement of the disconnect sleeve from the inner disconnect member.

14. The milling tool of claim 1, wherein the milling tool is movable to a second closed position where the cut-out blades cannot be extended despite an increase in drilling fluid pressure.

15. A method for cutting an inner casing string of a wellbore, the method comprising:

inserting a milling tool in the wellbore;

extending a cut-out blade located in a tool body of the milling tool;

cutting the inner casing string by the cut-out blade to form a starter window;

extending a milling blade located in the tool body; and cutting the inner casing string by the milling blade to form a full-length window, wherein the cut-out blade and the milling blade are extended from the tool body by circulating drilling fluid through the milling tool, and wherein the milling tool is movable between (i) a first closed position where the cut-out blade and the milling blade are not extended from the tool body, (ii) a first open position where the cut-out blade is extended and the milling blade is not extended from the tool body, and (iii) a second open position where the milling blade is extended and the cut-out blade is not extended from the tool body.

16. The method of claim 15, wherein extending the cut-out blade includes moving a piston head located in the tool body by applying force on the piston head by the drilling fluid.

17. The method of claim 15, wherein cutting the inner casing string to form the starter window includes rotating the milling tool when the cut-out blade is extended.

18. The method of claim 15, wherein extending the milling blade includes disengaging a shear member connected to the tool body from a shear sleeve.

19. A milling tool for cutting an inner casing string of a wellbore, the milling tool comprising:

a tool body;

an extendable cut-out blade located in the tool body and configured to cut the inner casing string to form a starter window; and an extendable milling blade located in the tool body and configured to cut the inner casing string to form a full-length window, wherein the milling blade is configured to extend from the tool body independently from the cut-out blade, and wherein the cut-out blade and the milling blade are configured to extend from the tool body by circulating drilling fluid through the milling tool, and wherein a distal end of the cut-out blade includes a stop member and a spring connected to and extending from the stop member, the spring being configured such that, when the cut-out blade is extended from the tool body, the spring is compressed against an outer wall of the tool body.

20. The method of claim 15, wherein a distal end of the cut-out blade includes a stop member and a spring connected to and extending from the stop member, the stop member being sized such that it obstructs movement of the cut-out blade beyond a predetermined position.

* * * * *